US009878864B2

(12) United States Patent
Peccetti

(10) Patent No.: US 9,878,864 B2
(45) Date of Patent: Jan. 30, 2018

(54) AUTOMATIC POSITIONING GROUP IN A WINDING MACHINE OF PLASTIC FILM

(71) Applicant: Eraldo Peccetti, Novara (IT)

(72) Inventor: Eraldo Peccetti, Novara (IT)

(73) Assignee: COLINES S.P.A., Novara (IT)

( * ) Notice: Subject to any disclaimer, the term of this patent is extended or adjusted under 35 U.S.C. 154(b) by 88 days.

(21) Appl. No.: 14/916,724

(22) PCT Filed: Sep. 16, 2014

(86) PCT No.: PCT/EP2014/002501

§ 371 (c)(1),
(2) Date: Mar. 4, 2016

(87) PCT Pub. No.: WO2015/043723

PCT Pub. Date: Apr. 2, 2015

(65) Prior Publication Data

US 2016/0200538 A1 Jul. 14, 2016

(30) Foreign Application Priority Data

Sep. 25, 2013 (IT) ..... M12013A1575

(51) Int. Cl.
*B65H 18/26* (2006.01)
*B65H 19/20* (2006.01)

(52) U.S. Cl.
CPC ..... *B65H 18/26* (2013.01); *B65H 19/20* (2013.01); *B65H 2511/142* (2013.01)

(58) Field of Classification Search
CPC ..... B65H 18/26; B65H 19/20
See application file for complete search history.

(56) References Cited

U.S. PATENT DOCUMENTS 2,973,158 A * 2/1961 Zernov ..... B65H 19/26 242/527.3
3,733,035 A * 5/1973 Schott, Jr. ..... B65H 19/2223 221/205
4,326,680 A * 4/1982 Tetro ..... B65H 19/2261 242/526

(Continued)

FOREIGN PATENT DOCUMENTS

DE 8633078 U1 2/1987
GB 2238527 A 6/1991

*Primary Examiner* — Sang Kim
(74) *Attorney, Agent, or Firm* — Themis Law

(57) ABSTRACT

An automatic positioning group in a machine for winding plastic film onto bobbins that determines the correct position of an operative oscillating element with respect to a core such as a bobbin of a film having a different diameter sizes, wherein the operative oscillating element is supported at first free ends of levers hinged on pins associated with a frame of the winding machine and oscillated by a related actuator. The levers extend, in an opposite position to the ends carrying the operative oscillating element into appendices which collaborate with at least one pair of abutments positioned on a respective cam rotated with respect to the frame by an actuator, wherein each of the abutments is positioned on the cam with a different radial dimension with respect to a rotation axis of the rotating cam. The operative oscillating element can consist of a contact roll or a cutting blade.

6 Claims, 4 Drawing Sheets

(56) References Cited

U.S. PATENT DOCUMENTS

| | | | | |
|---|---|---|---|---|
| 4,993,652 | A * | 2/1991 | Moeller | B65H 19/2215 242/527.3 |
| 5,267,703 | A | 12/1993 | Biagiotti | |
| 6,082,659 | A * | 7/2000 | Sankaran | B21C 47/245 242/527.2 |
| 2005/0103920 | A1 | 5/2005 | Gelli et al. | |

* cited by examiner

AUTOMATIC POSITIONING GROUP IN A WINDING MACHINE OF PLASTIC FILM

The present invention relates to an automatic positioning group in a machine for winding plastic film onto bobbins.

At present in the field of machines for winding plastic film onto bobbins, and in particular in the so-called stretch film or extensible film market, bobbins wound onto cores having a diameter of 2 or 3 inches, defined with respect to common use as "manual" use and "automatic" use, respectively, are required.

Bobbins for "manual" use must be produced with a relatively short length of wound material and consequently in order to reach high production rates, a bobbin-change cycle must be effected in a short time. To produce 150 ml bobbins at 600 m/min, for example, 4 changes per minute are required, and therefore a change every 15 seconds.

This does not allow an online production of bobbins having an extremely reduced diameter and weight at high rates, as could be desirable.

Furthermore, the necessity of producing very thin films (from 6 μm to 12 μm indicatively) has led to the study and creation of various expedients suitable for eliminating the basic problems that arise during the winding of such thin film.

As previously mentioned, a winder that is capable of winding plastic film onto cores having a selectively external diameter i.e. 2" or 3", must therefore be prepared for the use of various spindles of these reels in rapid times.

Having two different diameters of the core from which the winding of the bobbin initiates, in fact, makes it necessary to materially-change the position of some accessory elements of the machine destined for this purpose, which actively participate in the winding and bobbin-change phases.

In particular, as is well known, a winding machine has a contact roll which accompanies the film being wound onto the spindle of the reel. This arrangement is necessary for preventing a certain amount of air from remaining between the various layers of film, creating bubbles, with an incorrect and non-constant winding. In this case, the film would not be wound uniformly, with unaligned and superimposed coils, creating a deformed bobbin with an irregular surface.

The presence of a contact roll, moreover, requires that the roll be brought, right from the very first winding turn, into an operative contact position on the film enveloping the respective core, i.e. in such a position that the roll can intervene to create close contact between the core and first turn of the film being wound.

The starting position of the contact roll must therefore be regulated in relation to the initial diameter of the core selected, which, as already specified, can be different.

In current winding machines, this operation is normally effected by the line operator during the preliminary start-up phases, by acting with specific instruments on the supporting levers of the roll. The necessity of intervening on the part of the operator always entails the possibility of human error and in any case, as a result, that the subsequent winding is incorrect. Furthermore, the necessity of spending time for intervening with these instruments on the pair of levers, requires a stoppage time for the intervention, which could otherwise be used for normal production.

A further problem relating to the intervention of an operator derives from the fact that, in order to effect this intervention, the operator must "enter" the winding machine with the constant risk of a possible accident. This creates numerous problems from the point of view of safety.

An analogous problem arises with the transversal cutting group of the tail of film wound onto the bobbin now created and complete, which intervenes with every bobbin change.

The film wound onto the core, in fact, causes the formation of a bobbin which, once the correct diameter size has been reached, is removed from the winding machine.

If the starting cores have different diameters, the bobbins consequently also have different diameters: said diameter also being determined in relation to the final use previously indicated.

In order to remove the finished bobbin, the above-mentioned transversal cutting group of the tail of film wound onto the bobbin, is envisaged.

With a variation in the diameter of the bobbin, this group must have an adequate run so as not to damage the coils of film wound or so as not to cut the tail of the film being wound.

As for the previous group, at present, there is an intervention on the part of an operator, who varies the position of a pair of levers carrying the transversal cutting group of the tail of the film.

This intervention also entails a waste of time, a Possible positioning error and in any case possible danger for the operator who must "enter" the system without protection, especially in this case, as the intervention is close to a cutting blade, whose safety measurements require further time necessary for completing all the operations.

A general objective of the present invention is to solve the drawbacks of the known art indicated above in an extremely simple, economical and particularly functional manner.

A further objective of the present invention is to provide an automatic positioning group in a machine for winding plastic film onto bobbins which reduces dead times for machine stoppage.

Another objective of the present invention is to provide an automatic positioning group in a machine for winding plastic film onto bobbins which eliminates any type of human intervention inside the machine, nullifying any danger of injury, even accidental.

Yet another objective of the present invention is to provide an automatic positioning group in a machine for winding plastic film onto bobbins which guarantees the correct position required independently of any human factor.

In view of the above objectives, according to the present invention, an automatic positioning group in a machine for winding plastic film onto bobbins has been conceived, having the characteristics specified in the enclosed claims.

The structural and functional characteristics of the present invention and its advantages with respect to the known art will appear even more evident from the following description, referring to the enclosed drawings, which show embodiments of an automatic positioning group in a machine for winding plastic film onto bobbins produced according to the present invention.

In the embodiments shown, the possibility is assumed of operating under two different conditions for each group illustrated, but alternatively and almost analogously, there can also be more than two positions.

Figure 1:
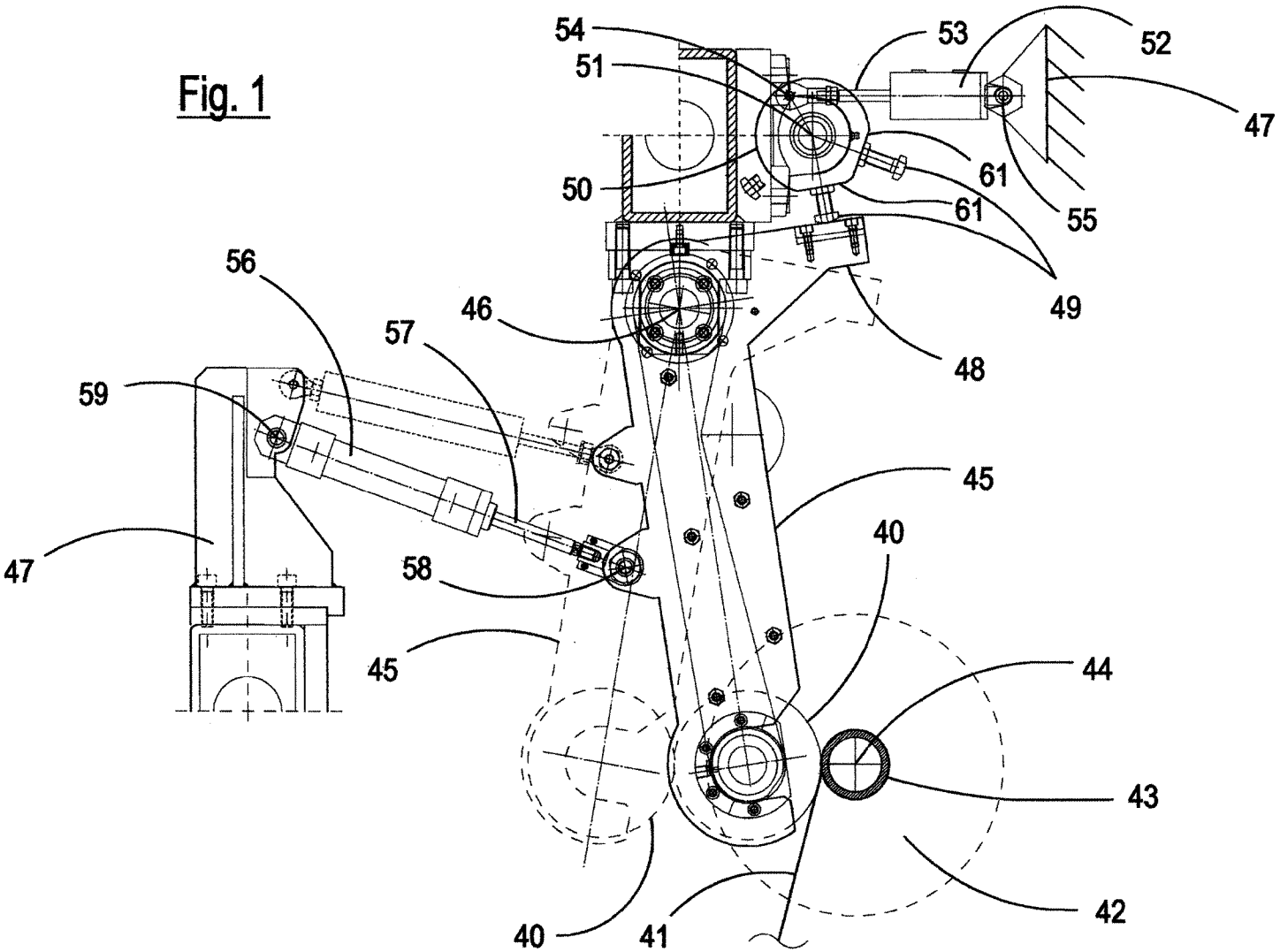
FIG. 1 is a raised schematic side end-view showing part of a winding machine which comprises a first embodiment of an automatic positioning group in a machine for winding plastic film onto bobbins produced according to the invention, suitable for determining the correct position of a contact roll.
Figure 2:
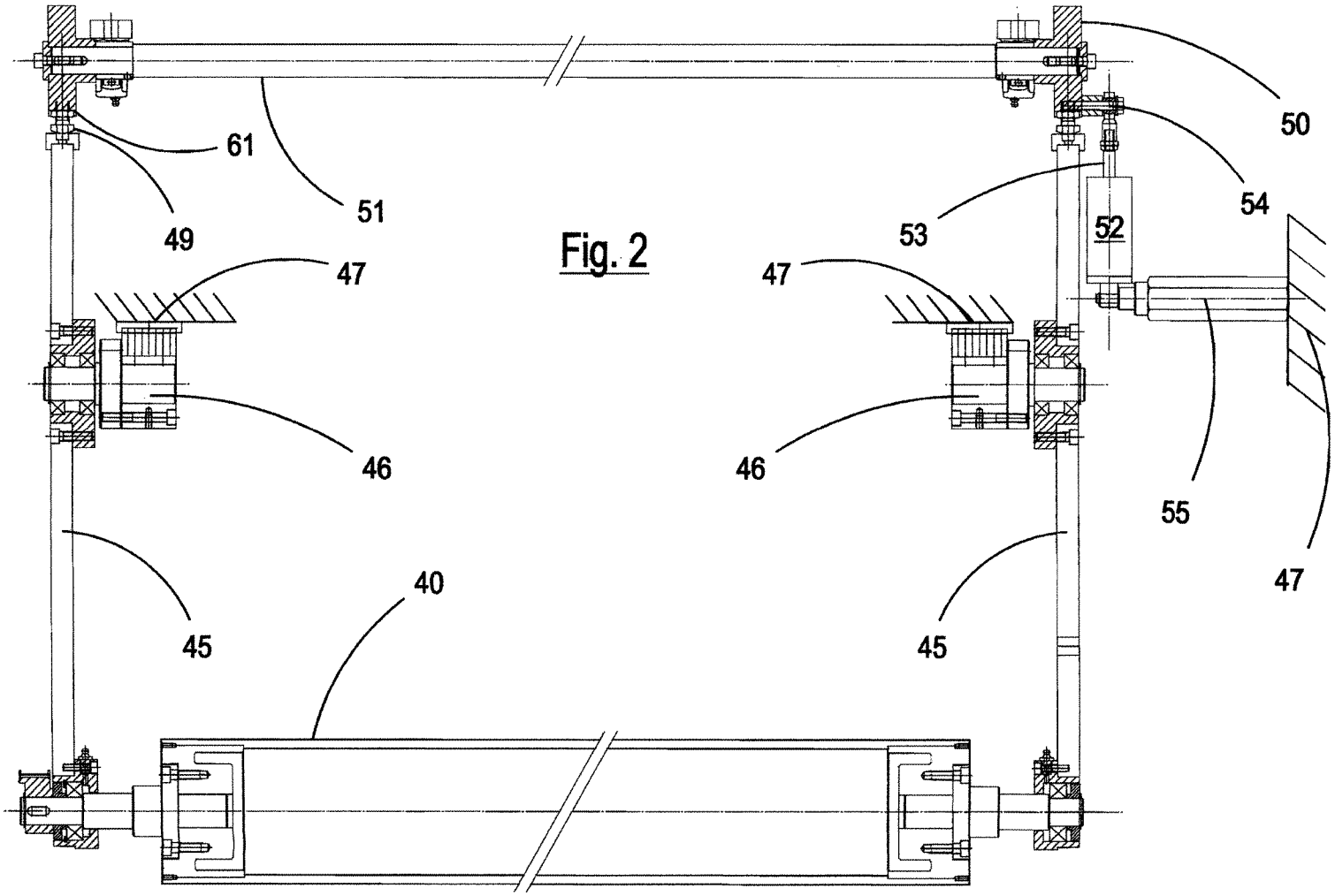
FIG. 2 is a front view showing as a whole the group of FIG. 1, with elements partially shown.

As already indicated, FIGS. 1 and 2 show a first embodiment of an automatic positioning group in a machine for winding plastic film onto bobbins, only partially shown, which is produced according to the invention.

In particular, this first automatic positioning group is suitable for determining the correct position of a contact roll 40 on a film 41 being wound onto a bobbin 42 produced on a core 43 positioned on a spindle 44.

The group according to the invention therefore effects the automatic positioning of an oscillating operative element with respect to the core 43 or film 41 with a variation in the diameter size of the core or final bobbin of wound film.

The oscillating operative element in the first embodiment shown in FIGS. 1 and 2 consists of the contact roll 40.

This contact roll 40 is supported, free to rotate, at first free ends of levers 45 which, in an intermediate portion, are pivoted to two pins 46, associated at their ends with a frame of the machine, partially schematized in its parts 47.

Said levers 45 extend, in an opposite position with respect to the end carrying the contact roll 40, into appendices 48, in the example arranged at right angles with respect to the body of each lever 45. Said appendices 48 collaborate with at least one pair of abutments 49, 49', having a preselected variable radial dimension, positioned on a respective rotating cam 50. In this example, the abutments 49, 4'9' consist of shrew elements inserted to a lesser or greater extent with respect to a rotation axis in location planes 61 positioned on the perimeter of the cam 50. Each rotating cam 50 can rotate around a shaft 51 also supported with respect to parts of the frame 47, by means of an actuator 52, consisting, for example, of a single-acting pneumatic cylinder, positioned on a side of the machine. The shaft 51 correlates and creates the movement of both of the two cams 50.

A stem 53 of the cylinder 52 is hinged in 54 to the cam 50, whereas the body of the cylinder 52 is hinged in 55 to a part of the frame 47.

In addition, each lever 45 is oscillated around the pin 46 by means of an actuator 56, consisting for example of at least one single-acting pneumatic or hydraulic cylinder. In particular, a stem 57 of the cylinder 56 is hinged in 58 to the lever 45, whereas the body of the cylinder 56 is hinged in 59 to a part of the frame 47.

FIG. 1 shows in a whole line, a first position in which the core 43 positioned on the spindle 44 has a first dimension which is smaller with respect to that of a further second core (not shown) that can be used on the winding machine. The presence of this core 43 having a smaller diameter determines the use of the first abutment 49, having a smaller radial dimension, arranged on the rotating cam 50. To allow this first abutment 49 to be positioned in correspondence with the appendix 48, the stem 53 of the cylinder 52 is in an extracted position. As said stem 53 is hinged in 54 to a cam 50, in turn connected to the other cam 50 by means of the shaft 51, it determines the coordinate and desired positioning of both cams 50.

When a core 43 having a larger diameter than the previous one is positioned on a spindle 44, the contact roll 40 must be maintained in a more detached position with respect to the spindle 44. For this purpose, the stem 53 of the cylinder 52 is re-entered causing the rotation of the cam 50 around the shaft 51. The second abutment 49', having a greater radial dimension with respect to the previous abutment, is therefore positioned in correspondence with the appendix 48 of the lever 45. This causes a stoppage of the lever 45 with the actuation of the cylinder 56 in a more detached position with respect to the spindle 44, carrying the core 43 having a larger diameter size.

All of this is effected with perfect automatism and with extreme rapidity, without any intervention inside the machine, and without any time loss for stoppages in production.

Everything takes place automatically as soon as the use of cores having a larger diameter than the previous ones, has been decided, solving all the problems of the machine so far known.

Figure 3:
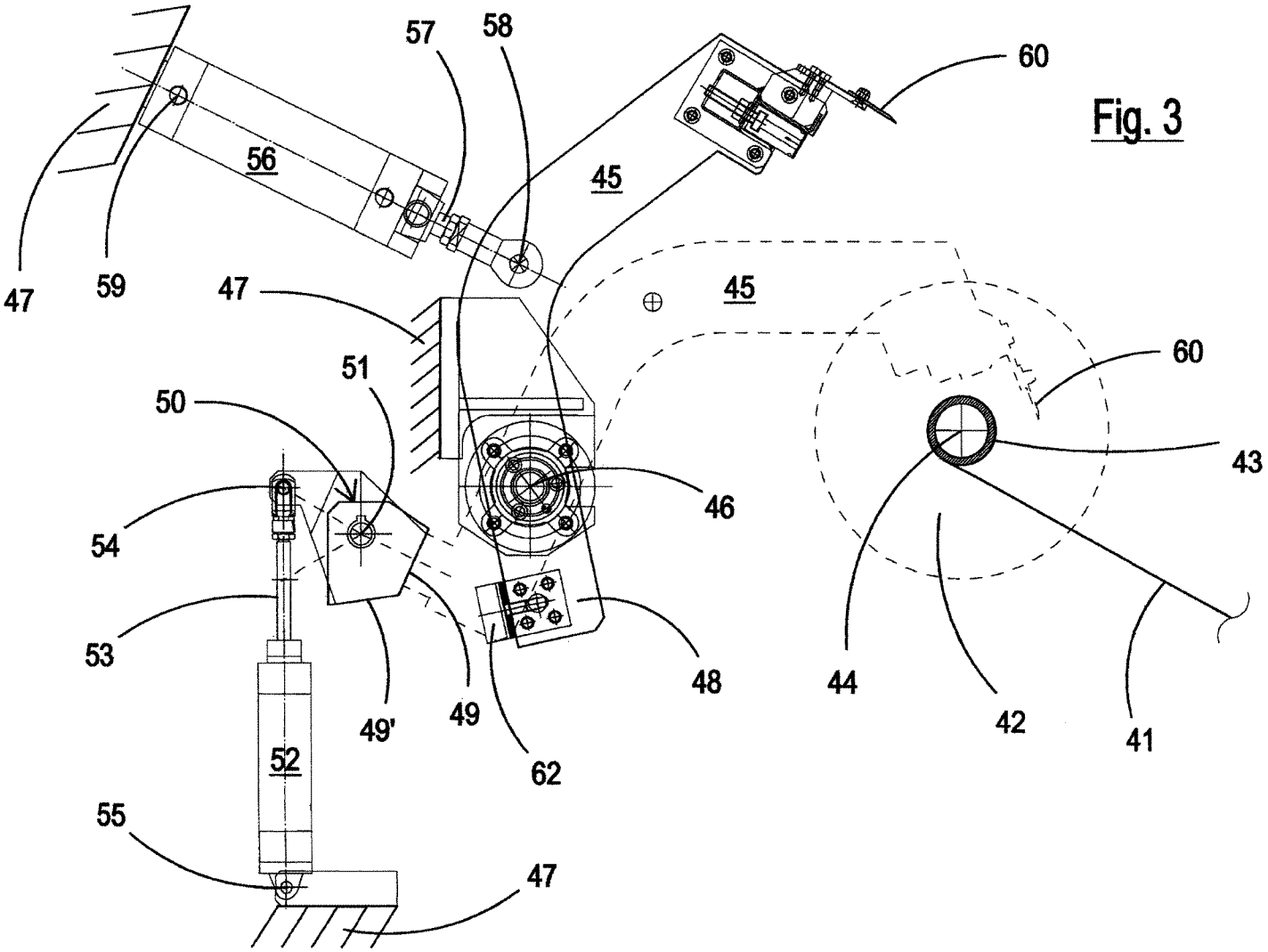
FIG. 3 is a view similar to that of FIG. 1, comprising a second embodiment of an automatic positioning group in a machine for winding plastic film onto bobbins produced according to the invention, suitable for determining the correct position of a transversal cutting blade of the film.
Figure 4:
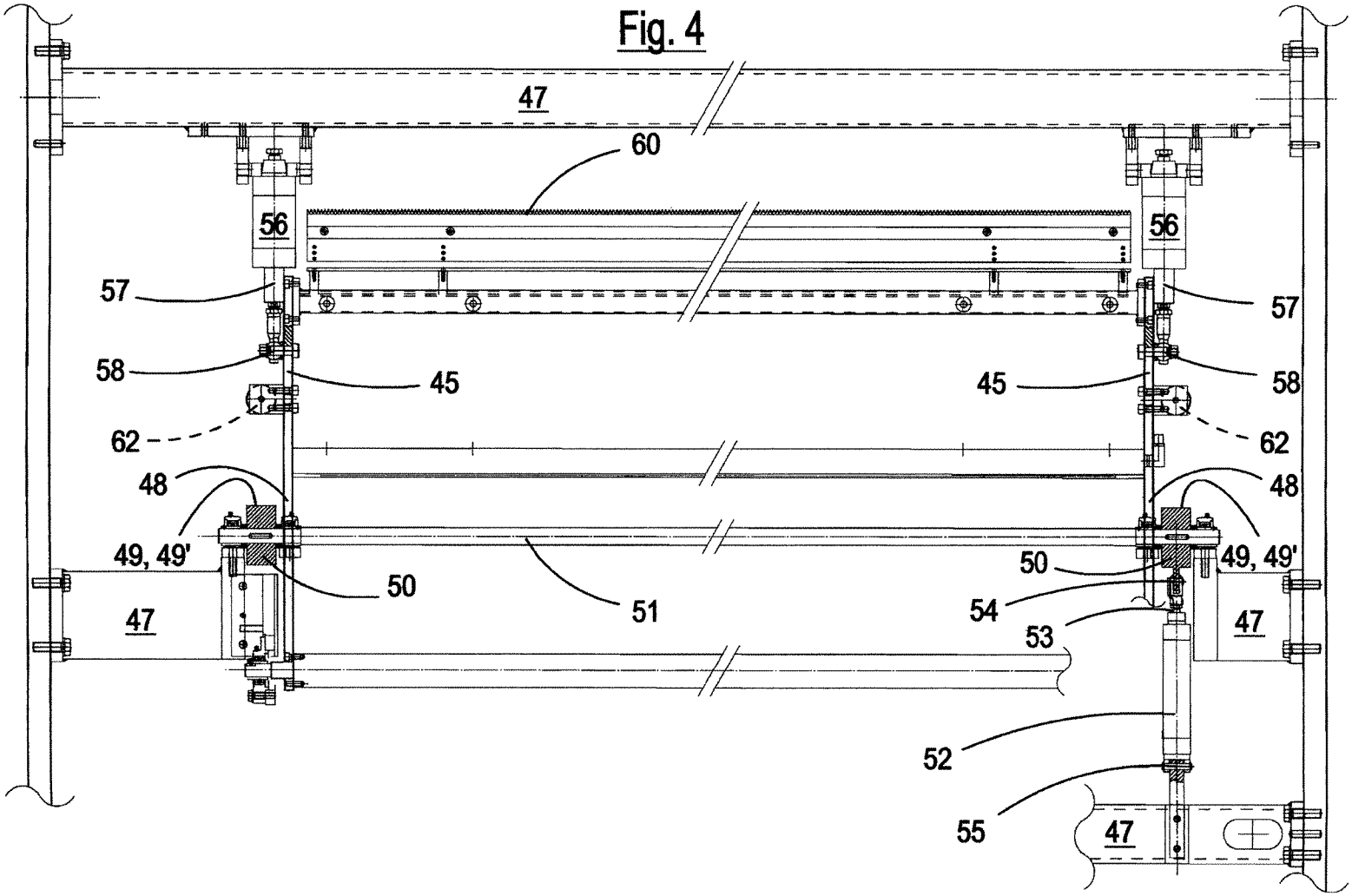
FIG. 4 is a front view showing as a whole the group of FIG. 3, with elements partially shown.

A further example of the solution according to the present invention is shown in the second embodiment of an automatic positioning group in a machine for winding plastic film onto bobbins of FIGS. 3 and 4.

In this embodiment, the automatic positioning group in a machine for winding plastic film onto bobbins, produced according to the invention, is suitable for determining the correct position of a transversal cutting blade 60 of the film 41 being wound onto a core 43 of a spindle 44, once the bobbin 42 is almost ready and completed. This group, therefore, also effects the automatic positioning of an oscillating operative element with respect to the core 43 or film 41 with a variation in the dimension of the final bobbin 42 of wound film 41.

The oscillating operative element in the second embodiment shown in FIG. 3 consists of a cutting blade 60.

When possible, the same reference numbers are used for the same or equivalent elements, also for this second embodiment.

This cutting blade 60 is supported at first free ends of levers 45 which, in an almost intermediate portion, are constrained by means of a pin 46 associated at its ends with a frame of the machine (not shown).

These levers 45 extend, in an opposite position with respect to the end carrying the cutting blade 60, into appendices 48, in the example arranged almost aligned with respect to the body of each lever 45. These appendices 48 collaborate with at least a pair of abutments 49, 49' positioned on a respective rotating cam 50. The abutments 49, 49', consisting of simple abutment surfaces in this example, are positioned at a different radial distance, which is variable and preselected, with respect to the rotation centre of the cam 50. Each rotating cam 50 is rotatable around a shaft 51 also supported with respect to parts of the frame (not shown), by means of an actuator 52, consisting for example of a single-acting pneumatic cylinder.

A stem 53 of the cylinder 52 is hinged in 54 to the cam 50 whereas the body of the cylinder 52 is hinged in 55 to a part of the frame 47.

Furthermore, each lever 45 is oscillated around the pin 46 by means of an actuator 56, consisting for example of a single-acting pneumatic cylinder. In particular, a stem 57 of the cylinder 56 is hinged in 58 to the lever 45 whereas the body of the cylinder 56 is hinged in 59 to a part of the frame 47.

FIG. 3 shows in an entire line, a first position in which the cutting blade 60 intervenes on a bobbin having a first diameter which is smaller with respect to that of an additional second bobbin (not shown) that can be produced on the winding machine.

The presence of this bobbin having a smaller diameter determines the use of the first stop surface or abutment 49, at a lesser radial distance with respect to the rotation centre of the rotating cam 50.

To ensure that the positioning of this first stop surface or abutment 49 is in correspondence with the appendix 48, the stem 53 of the cylinder 52 is in an extracted position. As said stem 53 is hinged in 54 to the cam 50, it obtains the desired positioning.

When a bobbin having a larger diameter with respect to the previous one is produced on the spindle 44, the cutting blade 60 must be brought to a more detached position with respect to the spindle 44. For this purpose, the stem 53 of the cylinder 52 is re-entered causing the rotation of the cam 50 around the shaft 51. As a result, the second stop surface or abutment 49', having a greater radial dimension with respect to the rotation centre, is arranged in correspondence with the appendix 48 of the lever 45. This causes a stoppage of the lever 45 upon activation of the cylinder 56 in a more detached position with respect to the spindle 44, carrying the bobbin having a larger diameter size.

Also in this second example, the whole operation is perfectly automated with extreme rapidity without any intervention inside the machine and without any time loss for production stoppages.

Everything is effected automatically as soon as the production of bobbins having a larger diameter than the previous ones, has been decided, solving all the problems of the machine so far known.

In FIG. 3, the appendices 48 of the levers 45 additionally carry buffer elements 62 which collaborate with the abutment surfaces 49 and 49' to cushion the stop.

In both cases, the fact of having two different starting diameters which, according to the known art, impose the necessity of materially changing the position of some accessory elements of the machine, has been solved.

According to the invention, everything is effected automatically by activating the cylinders and cams.

The present invention therefore eliminates both the possibility of error and also the dead time spent for this operation.

In both cases, the automation of these operations is also useful from the point of view of safety, as it avoids the necessity of the operator having to "enter" the winder with the residual risk of accidents.

All the objectives mentioned in the preamble of the description have therefore been achieved.

The forms of the structure for producing a group of the invention, as also the materials and assembly modes, can obviously differ from those shown for illustrative and non-limiting purposes in the drawings.

The protection scope of the invention is therefore delimited by the enclosed claims.

The invention claimed is:

1. An automatic positioning group in a machine for winding plastic film onto bobbins in order to determine a correct position of an operative oscillating element (40, 60) with respect to a core (43) comprising:

levers (45) hinged on pins (46) associated with a frame (47) of the machine for winding and having free ends that support the operative oscillating element (40, 60); and an actuator oscillating said respective lever, wherein said levers (45) extend, in an opposite position with respect to the free ends carrying said operative oscillating element (40, 60), into appendices (48) which collaborate with at least one pair of abutments (49, 49') each positioned on a cam (50) rotated with respect to said frame (47) by a second actuator (52), and wherein each of said abutments (49, 49') is positioned on said cam with a different radial dimension with respect to a rotation axis (51) of said cam (50).

2. The automatic positioning group according to claim 1, wherein said operative oscillating element consists of a contact roll (40).

3. The automatic positioning group according to claim 2, wherein said at least one pair of abutments (49, 49') consists of screw elements more or less inserted with respect to a rotating axis (51) of said cam (50) on flat areas (61) provided on a perimeter of the cam (50).

4. The automatic positioning group according to claim 1, wherein said operative oscillating element consists of a cutting blade (60).

5. The automatic positioning group according to claim 4, wherein said at least one pair of abutments (49, 49') consists of abutment flat areas situated on a perimeter of the cam (50) at a greater or lesser distance with respect to the rotation axis (51) of said cam (50).

6. The automatic positioning group according to claim 1, wherein said actuator comprises a stem movable in a cylindrical body (56), which is hinged at a free end (59) to a part of the frame (47), the stem being hinged (58) to said levers (45) at an intermediate position of said levers (45).

* * * * *